US005345954A

United States Patent [19]

Dall'osso et al.

[11] Patent Number: 5,345,954

[45] Date of Patent: Sep. 13, 1994

[54] METHOD OF CONTROLLING AND REGULATING THE TRAVELING SPEED OF A CONTINUOUS CIGARETTE ROD ON A CIGARETTE MANUFACTURING MACHINE

[75] Inventors: Davide Dall'osso; Franco Ghini, both of Bologna; Fiorenzo Draghetti, Medicina, all of Italy

[73] Assignee: G.D Societa' Per Azioni, Bologna, Italy

[21] Appl. No.: 986,592

[22] Filed: Dec. 7, 1992

[30] Foreign Application Priority Data

Dec. 12, 1991 [IT] Italy ..... B091 A 000470

[51] Int. Cl.[5] ..... A24C 5/18

[52] U.S. Cl. ..... 131/280; 131/55; 131/84.1; 198/810; 198/502.4

[58] Field of Search ..... 131/280, 55, 84.1, 910; 198/502.4

[56] References Cited

U.S. PATENT DOCUMENTS 3,989,989 11/1976 Mayer ..... 198/502.4
4,598,719 7/1986 Mattei ..... 131/84.1
4,653,516 3/1987 Mattei ..... 131/84.1 X
4,748,988 6/1988 Green et al. ..... 131/280
5,076,568 12/1991 de Jong et al. ..... 198/502.4 X
5,230,418 7/1993 Agnoff ..... 198/502.4

*Primary Examiner*—William H. Grieb
*Attorney, Agent, or Firm*—Marshall, O'Toole, Gerstein, Murray & Borun

[57] ABSTRACT

On a cigarette manufacturing machine, a continuous cigarette rod is fed to a cutting device by a conveyor belt engaging a number of guide pulleys and a drive pulley fitted to a drive shaft; the traveling speed of the continuous rod being controlled by continuously determining the diameter of the drive pulley, for obtaining a first control signal as a function of the surface speed of the drive pulley and, consequently, as a function of the speed of the conveyor belt, and by comparing the first control signal with a second control signal as a function of the desired surface speed of the drive pulley, for obtaining an error signal for controlling the angular speed of the drive shaft.

5 Claims, 1 Drawing Sheet

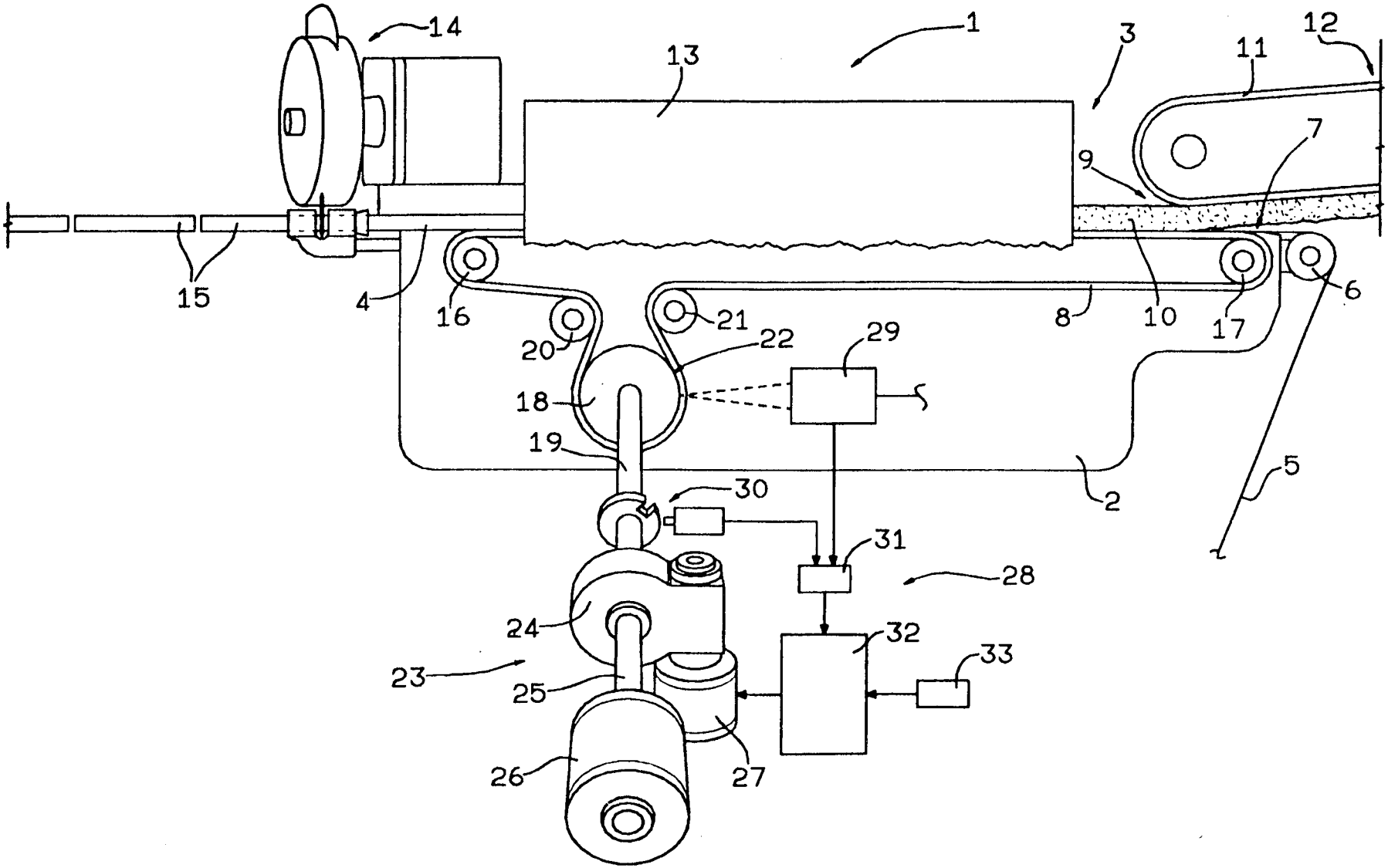
1
2
3
4
5
6
7
8
9
10
11
12
13
14
15
16
17
18
19
20
21
22
23
24
25
26
27
28
29
30
31
32
33

METHOD OF CONTROLLING AND REGULATING THE TRAVELING SPEED OF A CONTINUOUS CIGARETTE ROD ON A CIGARETTE MANUFACTURING MACHINE

BACKGROUND OF THE INVENTION

The present invention relates to a method of controlling and regulating the traveling speed of a continuous cigarette rod on a cigarette manufacturing machine.

On cigarette manufacturing machines, a continuous strip of paper is fed on a conveyor belt through a loading station where a stream of shredded tobacco is deposited on to the strip. The strip is then folded transversely about the tobacco to form a continuous cigarette rod, which is fed on the conveyor belt to a transverse cutting head.

A major problem for ensuring correct operation of known machines of the aforementioned type is that of so controlling the paper strip, and consequently the conveyor belt, that the traveling speeds of both are substantially constant and equal to a predetermined speed depending on the substantially constant rotation speed of the cutting head by which the continuous rod is cut into a succession of portions of, at least theoretically, the same length. Any departure, in fact, in the traveling speed of the strip from said predetermined value results in the rod being cut into portions of other than the required length.

In connection with the above, it should be pointed out that, on known machines of the aforementioned type, the conveyor belt is looped about a number of transmission pulleys and a drive pulley, and that any departure in the traveling speed of the belt from said predetermined value is mainly caused by gradual wear of the drive pulley and, consequently, for a given angular speed, by a gradual reduction in its-surface speed.

On known machines of the aforementioned type, the traveling speed of the paper strip is controlled by making and subsequently detecting relatively small marks on the strip, which, by means of a mark counting device, enable the traveling speed of the strip and, consequently, the conveyor belt to be determined substantially accurately, and any departure from said predetermined value to be accordingly eliminated.

The above known control method, however, fails to cater for relatively high-speed strips, in which case, vibration of the machine and the relatively limited time available for detecting the marks on the strip invariably result in reading errors and, consequently, misadjustment, thus jeopardizing correct operation of the machine.

SUMMARY OF THE INVENTION

It is an object of the present invention to provide a straightforward, reliable method of maintaining a constant given traveling speed of the paper strip for forming a continuous cigarette rod on a cigarette manufacturing machine.

According to the present invention, there is provided a method of controlling and regulating the traveling speed of a continuous cigarette rod on a cigarette manufacturing machine, whereby a continuous strip of paper is fed, through a tobacco loading station and along a continuous rod forming beam, to a transverse cutting device by means of a conveyor belt engaging a number of guide pulleys and a drive pulley fitted to a drive shaft; characterized by the fact that it comprises stages consisting in continuously determining the diameter of the drive pulley, preferably via optical detecting means, for obtaining a first control signal as a function of the surface speed of the drive pulley and, consequently, as a function of the speed of the conveyor belt; and in comparing said first control signal with a second control signal as a function of the desired surface speed of the drive pulley, for obtaining an error signal for controlling the angular speed of said drive shaft.

The above method preferably comprises a further stage consisting in determining the angular speed of said drive shaft, for obtaining a said first control signal proportional to the surface speed of said drive pulley.

According to a preferred embodiment of the present invention, said drive shaft is the output shaft of a differential device having a first and second input connected respectively to the output shaft of a first and second motor; said error signal being employed as a control signal for controlling the speed of said second motor.

BRIEF DESCRIPTION OF THE DRAWING

The present invention will be described with reference to the accompanying drawing showing a schematic view, partly in perspective, of a preferred non-limiting embodiment.

DETAILED DESCRIPTION OF THE INVENTION

Number 1 in the accompanying drawing indicates a cigarette manufacturing machine comprising a base 2 supporting a unit 3 for forming a continuous cigarette rod 4.

Unit 3 is supplied, by a known device (not shown), with a continuous paper strip 5, which is guided by roller 6 on to a substantially horizontal bed 7 defined by the top portion of base 2 and supporting the top branch of a conveyor belt 8 for advancing strip 5.

As it moves along bed 7, strip 5 travels through a loading station 9 where it is loaded with a continuous stream 10 of shredded tobacco by a suction conveyor belt 11 at the output of a known supply unit 12.

Downstream from loading station 9, strip 5 engages a forming beam 13 supported on bed 7 and by which a continuous cigarette rod 4 is formed in known manner from strip 5 and tobacco stream 10. At the output end of bed 7, red 4 is fed through a known cutting device 14 by which it is cut into cigarette portions 15.

Conveyor belt 8 is looped about transmission rollers 16 and 17 at either end of bed 7; about a drive pulley 18 fitted to a drive shaft 19 rotating anticlockwise in the drawing; and about two transmission rollers 20 and 21 located on either side of drive pulley 18, for ensuring adequate contact between conveyor belt 8 and the substantially cylindrical outer surface 22 of pulley 18.

Drive shaft 19 constitutes the output shaft of a drive unit 23 comprising a differential device 24 having an output connected to shaft 19, a first input connected to output shaft 25 of a first motor 26 operating at a given substantially constant angular speed, and a second input connected to the output shaft (not shown) of a second motor 27 the angular speed of which is controlled by a control unit 28.

Control unit 28 comprises a known optical device 29 positioned facing lateral surface 22 of drive pulley 18, for detecting the distance between surface 22 and a fixed reference point, and emitting a signal proportional to the diameter of surface 22. Unit 28 also comprises a known device 30 for detecting the angular speed of pulley 18 and emitting a signal proportional to the same. The above two signals are supplied to a known multiplying device 31, which emits a first control signal proportional to the surface speed of pulley 18, and supplies it to the input of a known comparing device 32, which, in addition to said first control signal, is also supplied with a second control signal emitted by an emitter 33 and proportional to a desired speed value. Comparing device 32 compares said first and second control signals, and, if necessary, emits an error signal which is employed in known manner for so regulating the speed of motor 27 as to zero the value of said error signal.

The traveling speed of conveyor belt 8 and, consequently, strip 5 and respective rod 4 may thus be maintained substantially constant despite gradual, and not always constant, wear of drive pulley 18.

We claim:

1. A method of controlling and regulating the traveling speed of a continuous cigarette rod (4) on a cigarette manufacturing machine (1), whereby a continuous strip of paper (5) is fed, through a tobacco loading station (9) and along a continuous rod forming beam (13), to a transverse cutting device (14) by means of a conveyor belt (8) engaging a number of guide pulleys (16, 17, 20, 21) and a drive pulley (18) fitted to a drive shaft (19); characterized by the fact that it comprises stages consisting in continuously determining the diameter of the drive pulley (18), for obtaining a first control signal as a function of the surface speed of the drive pulley (18) and, consequently, as a function of the speed of the conveyor belt (8); and in comparing said first control signal with a second control signal as a function of the desired surface speed of the drive pulley (18), for obtaining an error signal for controlling the angular speed of said drive shaft (19).

2. A method as claimed in claim 1, characterized by the fact that the diameter of the drive pulley (18) is determined continuously via optical detecting means (29).

3. A method as claimed in claim 1, characterized by the fact that the diameter of the drive pulley (18) is determined by detecting the distance between the outer surface (22) of the drive pulley (18) and a fixed point.

4. A method as claimed in claim 1, characterized by the fact that it comprises a further stage consisting in determining the angular speed of said drive shaft (19) for obtaining a said first control signal proportional to the surface speed of said drive pulley (18).

5. A method as claimed in claim 1, characterized by the fact that said drive shaft (19) is the output shaft of a differential device (24) having a first and second input connected respectively to the output shaft of a first (26) and second (27) motor; said error signal being employed as a control signal for controlling the speed of said second motor (27).

* * * * *